United States Patent [19]

Schmitt et al.

[11] Patent Number: 4,485,617

[45] Date of Patent: Dec. 4, 1984

[54] FALSE-TWIST APPARATUS

[75] Inventors: Günther Schmitt; Günther Oppl, both of Hammelburg; Kirit Patel, Elfershausen; Theo Bieber, Oberwerrn, all of Fed. Rep. of Germany

[73] Assignee: Fag Kugelfischer Georg Schäfer & Co., Schweinfurt, Fed. Rep. of Germany

[21] Appl. No.: 444,628

[22] Filed: Nov. 26, 1982

[30] Foreign Application Priority Data

Nov. 27, 1981 [DE] Fed. Rep. of Germany ..... 3147088

[51] Int. Cl.[3] ..... D02G 1/08

[52] U.S. Cl. ..... 57/340; 57/89; 57/104; 57/280; 57/348

[58] Field of Search ..... 57/279, 280, 339–340, 57/348, 104, 105, 88, 89

[56] References Cited

U.S. PATENT DOCUMENTS 4,047,374 9/1977 Venot ..... 57/348 X
4,060,967 12/1977 Lorenz ..... 57/348
4,226,080 10/1980 Bieber et al. ..... 57/280 X
4,333,308 6/1982 Schleyer et al. ..... 57/339

FOREIGN PATENT DOCUMENTS 2339416 4/1974 Fed. Rep. of Germany .
2943279 6/1981 Fed. Rep. of Germany .

*Primary Examiner*—John Petrakes
*Attorney, Agent, or Firm*—Karl F. Ross; Herbert Dubno

[57] ABSTRACT

A false-twist apparatus has three parallel shafts carrying interleaved sets of friction disks interconnected by drive belts for joint rotation; one of these shafts is journaled in a stationary mounting plate while the others are journaled in a carrier pivotally connected with that plate for swinging about a fulcrum offset from the three shaft axes whereby two of the disk sets can be separated to facilitate the introduction of a yarn into the intervening twisting region. A whorl on the carrier-supported shaft nearest the fulcrum is normally driven by frictional contact with a continuously moving tangential belt but is disengaged from that belt in the swung-out position of the carrier so that the disks are arrested during introduction of the yarn.

8 Claims, 3 Drawing Figures

FALSE-TWIST APPARATUS

FIELD OF THE INVENTION

Our present invention relates to an apparatus for imparting a false twist to a textile thread, referred to hereinafter as yarn, with the aid of three or possibly more sets of axially interleaved, continuously rotating friction disks carried on respective shafts that are parallel to one another.

BACKGROUND OF THE INVENTION

A false-twist apparatus of the type referred to is shown, for example, in commonly owned U.S. Pat. No. 4,226,080. As explained in that prior patent, the threading of such an apparatus—i.e. the introduction of a yarn into the region of disk overlap between the several shafts—is a relatively complex operation; the improvement disclosed and claimed in the patent relates to a loading device to be used for this purpose.

From German laid-open specification No. 23 39 416 it is known to provide two relatively swingable members on which three disk-carrying shafts of a false-twist apparatus are rotatably supported, with one shaft journaled in both members at their fulcrum while the journal bearings of the other two shafts lie at respective extremities of these members remote from that fulcrum. A relative swing of the support members from a working position, in which their disks are overlappingly interleaved, and an idle position, in which they are separated from one another, enables the insertion of the yarn into the twisting region. According to that disclosure, the shaft centered on the pivotal axis of the two members is continuously driven by a motor and is coupled by respective transmission belts with the other two shafts which therefore are always entrained thereby. While the continuous rotation of all three shafts is described in that publication as an advantage allegedly avoiding the risk of thread rupture, it has been found in practice that a relative swing of the two support members about a pivot constituted by a rotating shaft gives rise to oscillations which are also transmitted to the two outlying journal bearings whereby all three of these bearings are subjected to accelerated wear.

German laid-open specification No. 29 43 279 discloses an alternate false-twist apparatus of this general type in which two shaft-carrying support members are independently swingable about fixed fulcra lying on opposite sides of a third shaft. Such an arrangement prevents the interconnection of the shafts by transmission belts or the like so that each shaft must be provided with its own drive means.

OBJECT OF THE INVENTION

The object of our present invention is to provide an improved false-twist apparatus which facilitates the insertion of a yarn by the separability of two normally interleaved sets of disks while avoiding the drawbacks of prior-art structures of the general type referred to.

SUMMARY OF THE INVENTION

The apparatus according to our invention comprises support means forming first, second and third journal bearings for respective shafts which are parallel to one another and carry respective sets of axially separated friction disks that are overlappingly interleaved in a working position, as in the devices of the two German publications referred to above, the support means including a first and a second member provided with the first and second journal bearings at locations remote from a pivotal axis about which the two members are relatively swingable into an idle or insertion position in which the first and second sets of disks are separated from each other. The three shafts are interconnected for joint rotation by coupling means such as the transmission belts shown in the first-mentioned German publication. In contrast to the known arrangement, however, motion is imparted to these shafts only in the working position in which a whorl on one of these shafts frictionally engages a transport belt forming part of continuously operable drive means; the belt and the whorl are disengaged from each other in the idle position in which the shafts and their disks are consequently arrested. A swing into the working position brings the whorl into tangential contact with the transport belt for progressive frictional entrainment thereby with resulting gradual acceleration of the disks to their full operating speed.

According to a more particular feature of our invention, the first member of the support means is fixed with reference to the transport belt and the third journal bearing is advantageously formed on the second member at a location offset from the pivotal axis of the two members by a distance less than the spacing of the latter axis from the second bearing, with the whorl mounted on the shaft journaled in the third bearing. Since the swing of this third bearing is less than that of the second bearing, the re-engagement of the whorl with the transport belt is more gradual for a given maximum disk separation than it would be if the whorl were placed on the more outlying shaft journaled in the second bearing.

BRIEF DESCRIPTION OF THE DRAWING

The above and other features of our invention will now be described in detail with reference to the accompanying drawing in which.

SPECIFIC DESCRIPTION

Figure 1:
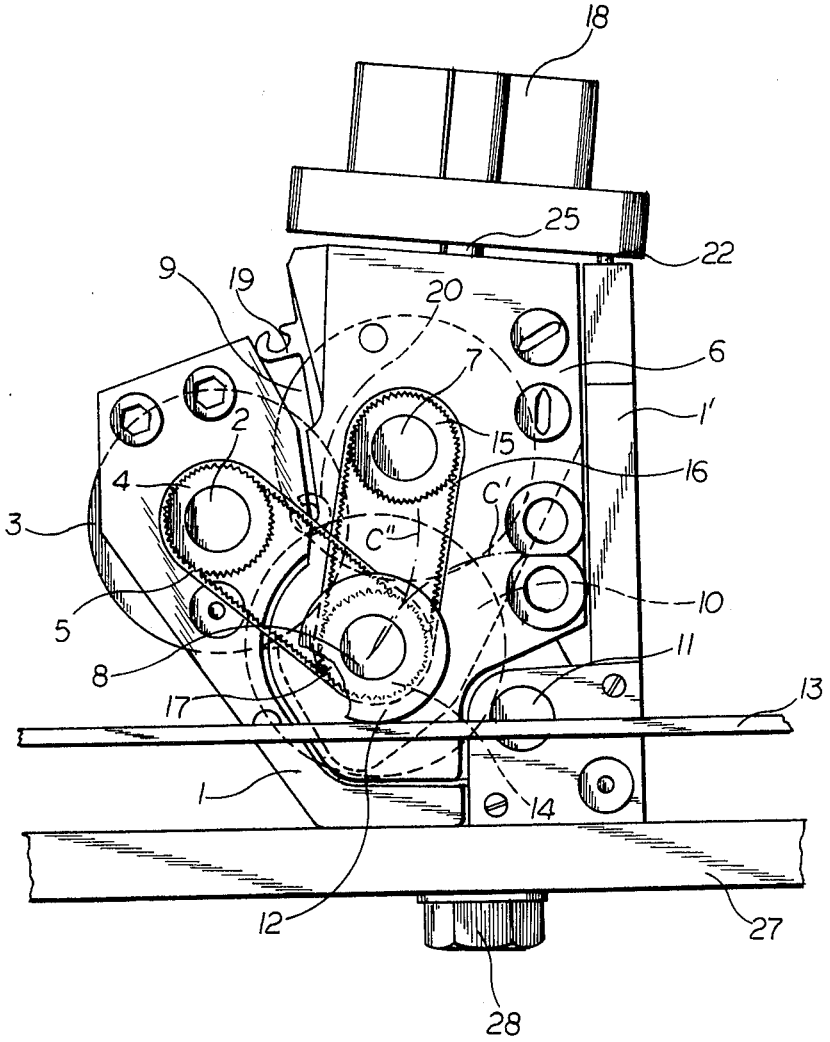
FIG. 1 is a bottom view of a false-twist apparatus embodying our invention, shown in its working position.

The apparatus shown in the drawing comprises a fixed support plate 1 which is secured to a horizontal bar 27 by a bolt 28 and forms a journal bearing for a first vertical shaft 2 carrying a set of axially spaced friction disks 3. A movable support plate 6 is pivotally connected with plate 1 at a fulcrum 11 and forms a journal bearing for a second vertical shaft 7 carrying another set of axially spaced friction disks 9. A third vertical shaft 8, journaled in plate 6 at a location closer to fulcrum 11, carries a further set of axially spaced friction disks 10 overlappingly interleaved with disks 9; a similar overlap exists in the working position of FIGS. 1 and 3 also with reference to disks 3, thanks to the axial offset of the several sets of disks from one another as is well known per se. When plate 6 is swung away horizontally from plate 1 into the idle position of FIG. 2, disks 3 and 9 no longer overlap and are separated from one another by a narrow, open-ended vertical gap or channel 21 facilitating the insertion of a yarn into the twisting region at the center of the triangle defined in the working position by the three shaft axes. The proper positioning of the inserted yarn is assisted by a lower and an upper thread guide 19 and 20 mounted underneath the channel 21 on plate 6.

Figure 2:
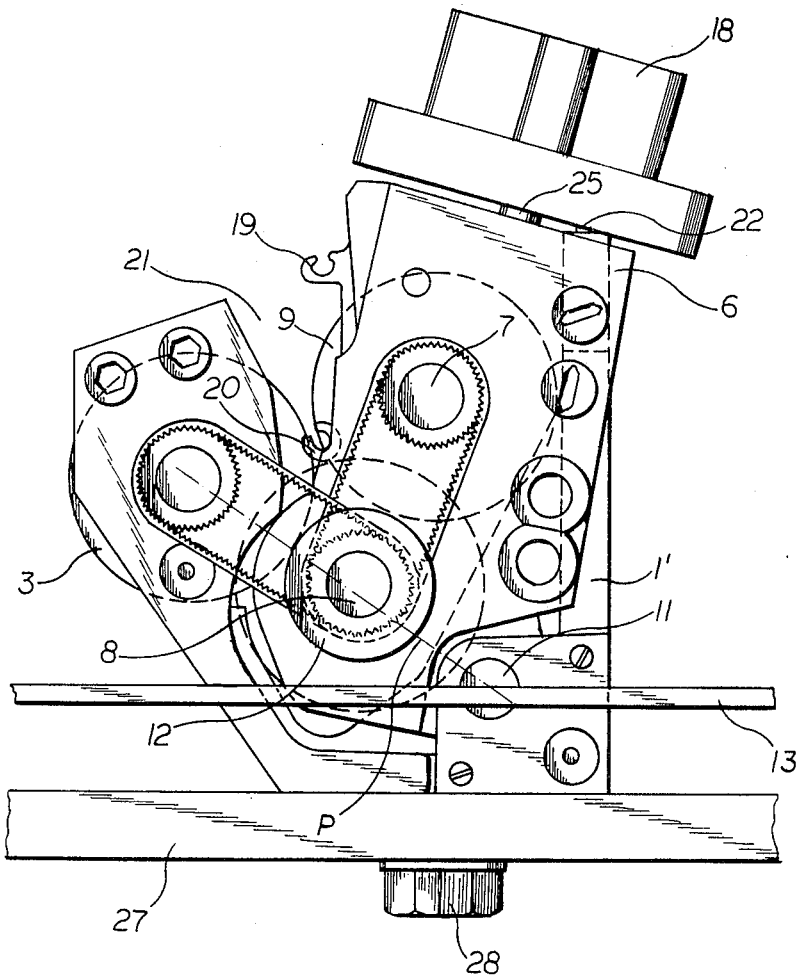
FIG. 2 is a view similar to that of FIG. 1 but showing the apparatus in its idle position.
Figure 3:
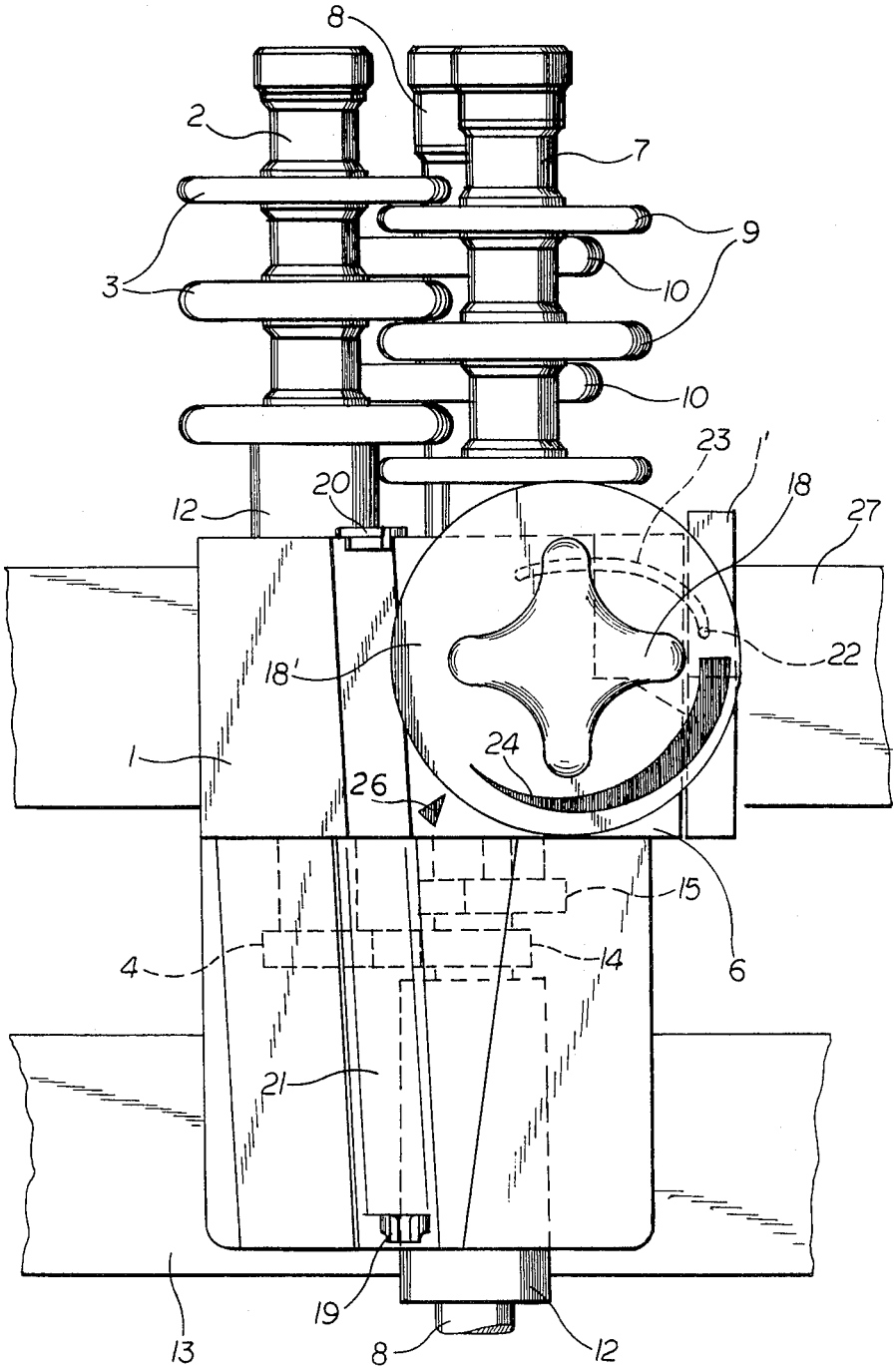
FIG. 3 is a front view of the apparatus.

Shaft 8 carries two pulleys 14 and 17 which are respectively disposed on the level of a pulley 15 on shaft 7 and on the level of a pulley 4 on shaft 2, these pulleys being provided with gear teeth for positive engagement by a pair of toothed transmission belts 5 and 16 respectively coupling the shaft 8 with shafts 2 and 7 for codirectional rotation. Shaft 8 is further provided with a whorl 12 which in the working position of FIGS. 1 and 3 is in frictional contact with a tangentially disposed transport belt 13 forming part of a continuously operative drive mechanism and also serving a number of other, similar false-twist assemblies not shown. When plate 6 is swung about its vertical pivotal axis into the idle position of FIG. 2, that movement lifts the whorl 12 off the transport belt 13 so as to stop the rotation of the shafts. It will be noted that the axis of shaft 8, lying approximately midway between pivot 11 and shaft 2, is located close to a vertical plane P (FIG. 2) including the pivotal axis and the axis of shaft 2, passing through that plane on moving from the working position of FIG. 1 to the idle position of FIG. 2 or vice versa. In so moving, the axis of shaft 8 follows an imaginary cylinder surface C′ (FIG. 1) centered on the pivotal axis of fulcrum 11, this surface C′ defining a narrow lenticular space with a similar surface C″ centered on the axis of shaft 2. Thus, the swing of shaft 8 about its pivotal axis slackens the transmission belt 5 only slightly, well within the range of tolerance for the maintenance of positive engagement of that belt with the toothed pulleys 4 and 17. Owing to the joint movement of shafts 7 and 8, the tension of belt 16 is not affected by that swing.

A device for manually controlling the swing of plate 6 with its shafts 7 and 8 comprises a knob 18 which is limitedly rotatable about a horizontal stub 25 on plate 6 and has a spiral groove 23 engaged by a stationary pin 22 on an extension 1′ of plate 1. The eccentricity of groove 23 is so chosen that a swing between the positions of FIGS. 1 and 2 requires only slightly more than a quarter turn of knob 18. An arcuate mark 24 on the face of knob 18, coacting with a pointer 26 on plate 6, visually apprises the operator by its varying width of the size of the gap 21 in any position of that knob. Closure of the assembly by a counterclockwise rotation of the knob 18, as viewed in FIG. 3, brings the whorl 12 into progressively increasing frictional contact with belt 13 for a gradual acceleration of the disks so as to avoid the risk of yarn rupture.

We claim:

1. A false-twist apparatus comprising:

a first, a second and a third shaft parallel to one another;

support means forming first, second and third journal bearings rotatably engaging said first, second and third shafts, respectively, said support means including a first and a second member which are relatively swingable about a pivotal axis extending in the direction of said shafts between a working position and an idle position, said first and second members being provided with said first and second journal bearings at locations remote from said pivotal axis;

first, second and third sets of axially separated friction disks respectively carried on said first, second and third shafts in axially offset relationship, the disks of all three sets being overlappingly interleaved in said working position, the disks of said first and second sets being separated in said idle position for enabling the introduction of a yarn into a twisting region between said shafts;

coupling means positively interconnecting said first, second and third shafts in said working and idle positions; and continuously operable drive means including a transport belt frictionally engaging a whorl on one of said shafts in said working position for jointly rotating said shafts through the intermediary of said coupling means, said whorl being automatically disengaged from said transport belt in said idle position.

2. An apparatus as defined in claim 1 wherein said first member is fixed with reference to said transport belt, said third journal bearing being formed on said second member at a location offset from said pivotal axis by a distance less than the spacing of said pivotal axis from said second journal bearing said whorl being mounted on said third shaft.

3. An apparatus as defined in claim 2 wherein said third shaft lies close to a plane including said pivotal axis and the axis of said first shaft, the axis of said third shaft passing through said plane on a swing of said second member between said working and idle positions.

4. An apparatus as defined in claim 3 wherein said coupling means includes a toothed transmission belt engaging respective gears on said first and third shafts with a permissible slack exceeding the change in the spacing of said first and third shafts during a swing of said second member between said working and idle positions.

5. An apparatus as defined in claim 2, further comprising manual control means on one of said members positively linked with the other of said members for relatively displacing same between said working and idle positions.

6. An apparatus as defined in claim 5 wherein said control means comprises a knob rotatably disposed on said second member and provided with a camming formation engaged by a cam follower on said first member.

7. An apparatus as defined in claim 6 wherein said camming formation is a spiral groove.

8. An apparatus as defined in claim 2, further comprising yarn-guiding means on said second member.

* * * * *